United States Patent [19]

Geschwindner et al.

[11] 4,452,442

[45] Jun. 5, 1984

[54] DEVICE FOR REGISTERING THE REAR EDGES OF THE SHEETS IN SHEET DELIVERY MECHANISMS FOR PRINTING MACHINES

[75] Inventors: Herbert Geschwindner, Wachtersbach; Paul Abendroth, Offenbach am Main, both of Fed. Rep. of Germany

[73] Assignee: M.A.N.-Roland, Fed. Rep. of Germany

[21] Appl. No.: 362,057

[22] Filed: Mar. 26, 1982

[30] Foreign Application Priority Data

Mar. 31, 1981 [DE] Fed. Rep. of Germany ..... 3112672

[51] Int. Cl.[3] ..... B65H 29/04

[52] U.S. Cl. ..... 271/204; 271/182; 271/218; 271/223; 271/224

[58] Field of Search ..... 271/204, 206, 182, 183, 271/217, 218, 223, 224

[56] References Cited

U.S. PATENT DOCUMENTS

| | | | |
|---|---|---|---|
| 3,796,427 | 3/1974 | Reutter | 271/204 |
| 3,960,374 | 6/1976 | Gaffney | 271/218 |

FOREIGN PATENT DOCUMENTS

| | | |
|---|---|---|
| 1116239 | 11/1961 | Fed. Rep. of Germany . |
| 2047808 | 4/1972 | Fed. Rep. of Germany . |
| 1196687 | 7/1970 | United Kingdom . |

*Primary Examiner*—Bruce H. Stoner, Jr.
*Assistant Examiner*—John A. Carroll
*Attorney, Agent, or Firm*—Leydig, Voit, Osann, Mayer & Holt, Ltd.

[57] ABSTRACT

A delivery mechanism for a sheet fed printing press in which a rear edge guide in the form of a traverse member guides the rear edges of the downwardly settling sheets into a condition of register. A brake assembly is provided for engaging the trailing edges of the sheets to decelerate them, the assembly being horizontally adjustable to accommodate sheets of different length and the traverse member being coupled by linkage to the brake assembly for simultaneous adjustment therewith. An intermediate stacking mechanism is provided having a horizontal frame and an intermediate pile receiver which is shiftable between a receiving position and an out-of-the-way position for temporarily accumulating sheets during a pile change. Detent assemblies at the ends of the traverse member lock the traverse member to the frame following horizontal adjustment. The frame of the intermediate stacking mechanism is adjustable in vertical position and the linkage for connecting the traverse member to the braking assembly is vertically extensible, being in the form of a pantograph, so that the traverse member serves as a positively positioned rear edge guide for both (a) the sheets deposited to form the intermediate pile and (b) the sheets subsequently deposited thereon to form a main pile thereby to maintain the rear edges of all of the sheets in register.

8 Claims, 12 Drawing Figures

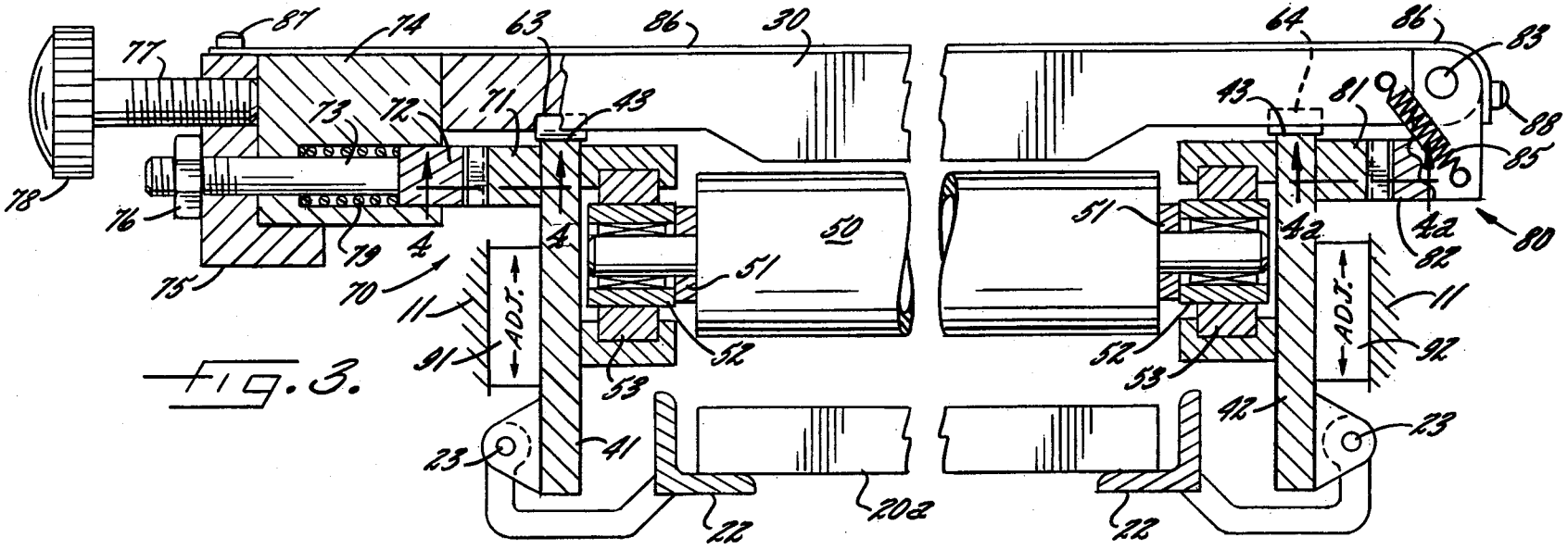
FIG. 3.
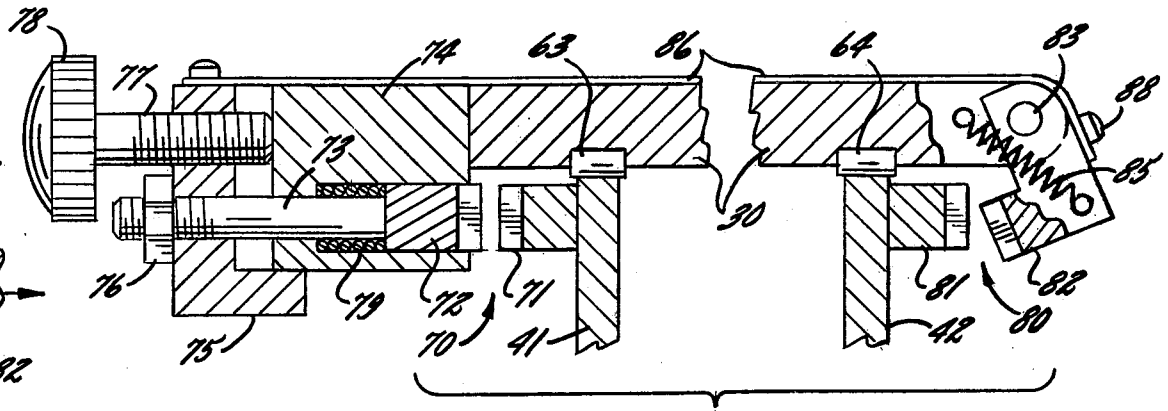
FIG. 5.
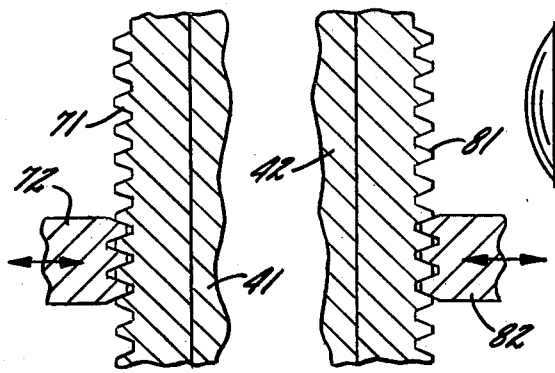
FIG. 4a.
FIG. 4.

PILE BEING COMPLETED
ROLLERS OUT OF THE WAY

FILLED PILE BOARD LOWERED
ROLLERS INTERPOSED

ROLLERS COLLECTING SHEETS
FILLED PILE BOARD REMOVED
NEW PILE BOARD INSERTED

ROLLERS BEING RETRACTED
TO TRANS. INTERMEDIATE PILE

INTERMEDIATE PILE
FULLY TRANSFERRED

NEW SHEETS BEING ADDED
IN REGISTER WITH TRANS. PILE

DEVICE FOR REGISTERING THE REAR EDGES OF THE SHEETS IN SHEET DELIVERY MECHANISMS FOR PRINTING MACHINES

In a sheet fed printing press sheets are conveyed one by one to a pile in a delivery mechanism. Where the press is capable of handling thick stock at high speed the pile increases at such a rate as to require changing several times during a typical press run. In order not to interfere with the production rate modern presses have provision for interposing a temporary pile board, also referred to as an "intermediate pile receiver", to intercept and collect the sheets while the main pile board is being replaced. The sheets from the temporary pile board are subsequently added to the pile but the added sheets will usually not be in precise register.

Accordingly, it has been proposed to employ a so-called rear edge sheet stop as shown, for example, in German Patent No. 20 47 808. Such a stop can be moved out of the space required by the intermediate pile receiver and subsequently lowered to a position close to the surface of the intermediate pile receiver when the latter is in place. The disadvantage of devices of this type, however, is that they are awkward to use and can be adjusted only with difficulty, if at all, to accomodate variations in sheet size.

Accordingly, an object of the present invention is to provide an easily adjusted and positively positioned rear edge guide which serves both to position the sheets deposited on the intermediate pile and on the main pile so that when the intermediate pile receiver is withdrawn to its out-of-the-way position the sheets in both of the piles will be combined in register with one another.

It is a more specific object to provide, in a sheet delivery mechanism, a rear edge guide in the form of a traverse member which is so mounted as to be adjustable automatically in both horizontal and vertical position. Thus, it is an object, to provide a rear edge guide which is (1) coupled by a linkage to the brake assembly for horizontal movement with the brake assembly as the same is adjusted for sheet size and which is (2) coupled to the frame of the intermediate stacking mechanism for vertical movement therewith when the intermediate stacking mechanism is vertically adjusted with respect to the main frame.

It is another object of the invention in one of its aspects to provide a rear edge guide in the form of a traverse member which is effective over the entire rear width dimension of the pile and which therefore prevents the relative skewing of the main and intermediate portions of the pile which can occur employing rear edge guides of more conventional construction.

Other objects and advantages of the invention will become apparent upon reading the attached detailed description and upon reference to the drawings in which:

FIG. 3 is a fragmentary section, enlarged and foreshortened, taken along line 3—3 in FIG. 1.

FIGS. 4 and 4*a* are fragmentary sections taken along correspondingly numbered lines in FIG. 3 showing the profiles of the detent mechanisms at each end of the rear edge guide, or traverse member.

FIG. 5 shows a portion of FIG. 3 with the detent mechanisms disengaged.

FIGS. 6–11 inclusive are stop motion views showing a typical pile change procedure occurring in the structure described in the earlier figures.

While the invention has been described in connection with a preferred embodiment, it will be understood that there is no intention to limit the invention to the embodiment shown but it is intended, on the contrary, to cover the various alternative and equivalent constructions included within the spirit and scope of the appended claims.

Figure 1:
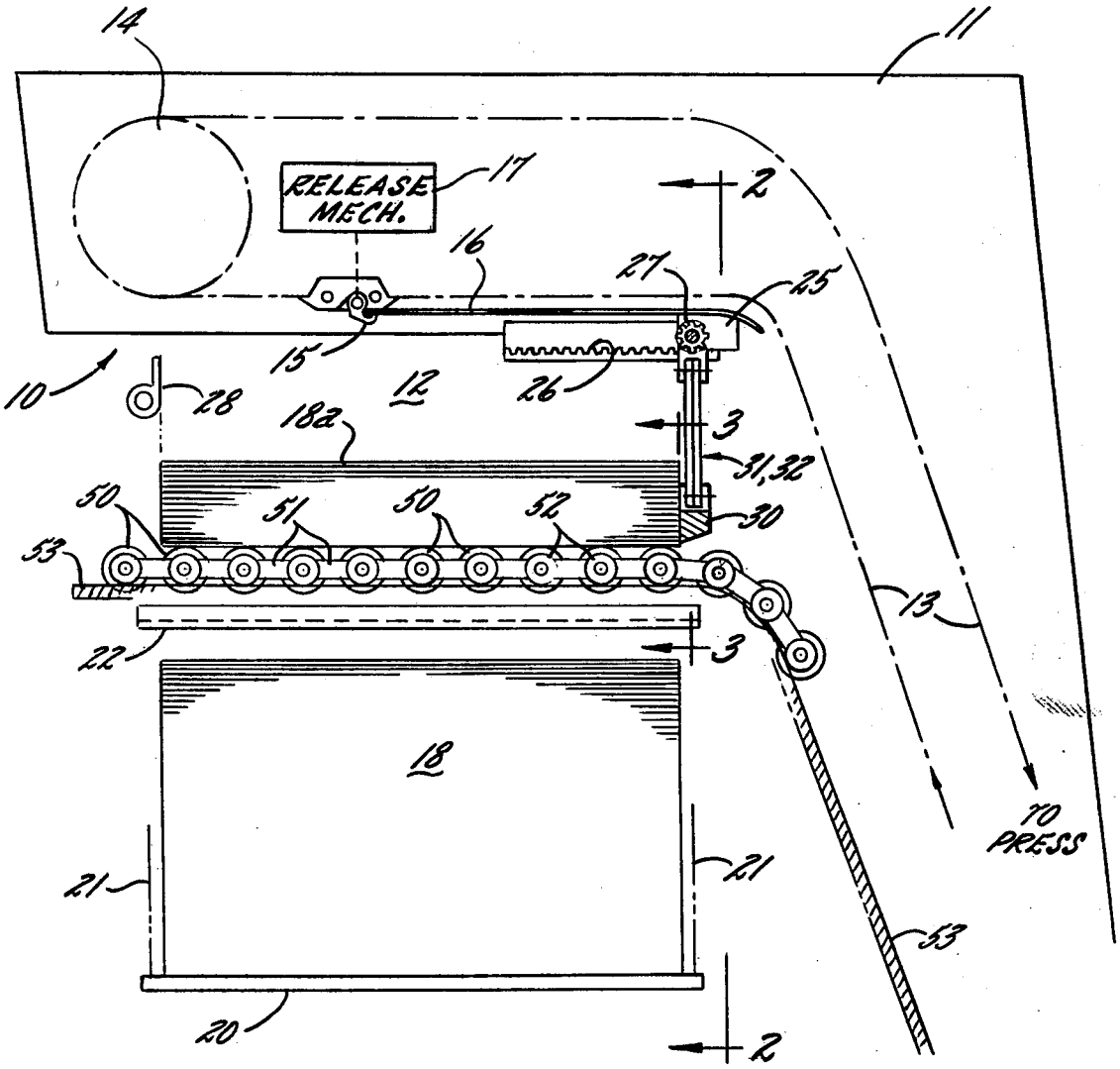
FIG. 1 is a diagrammatic side elevation of a delivery mechanism embodying the present invention, as viewed in section along line 1—1 in FIG. 2.
Figure 2:
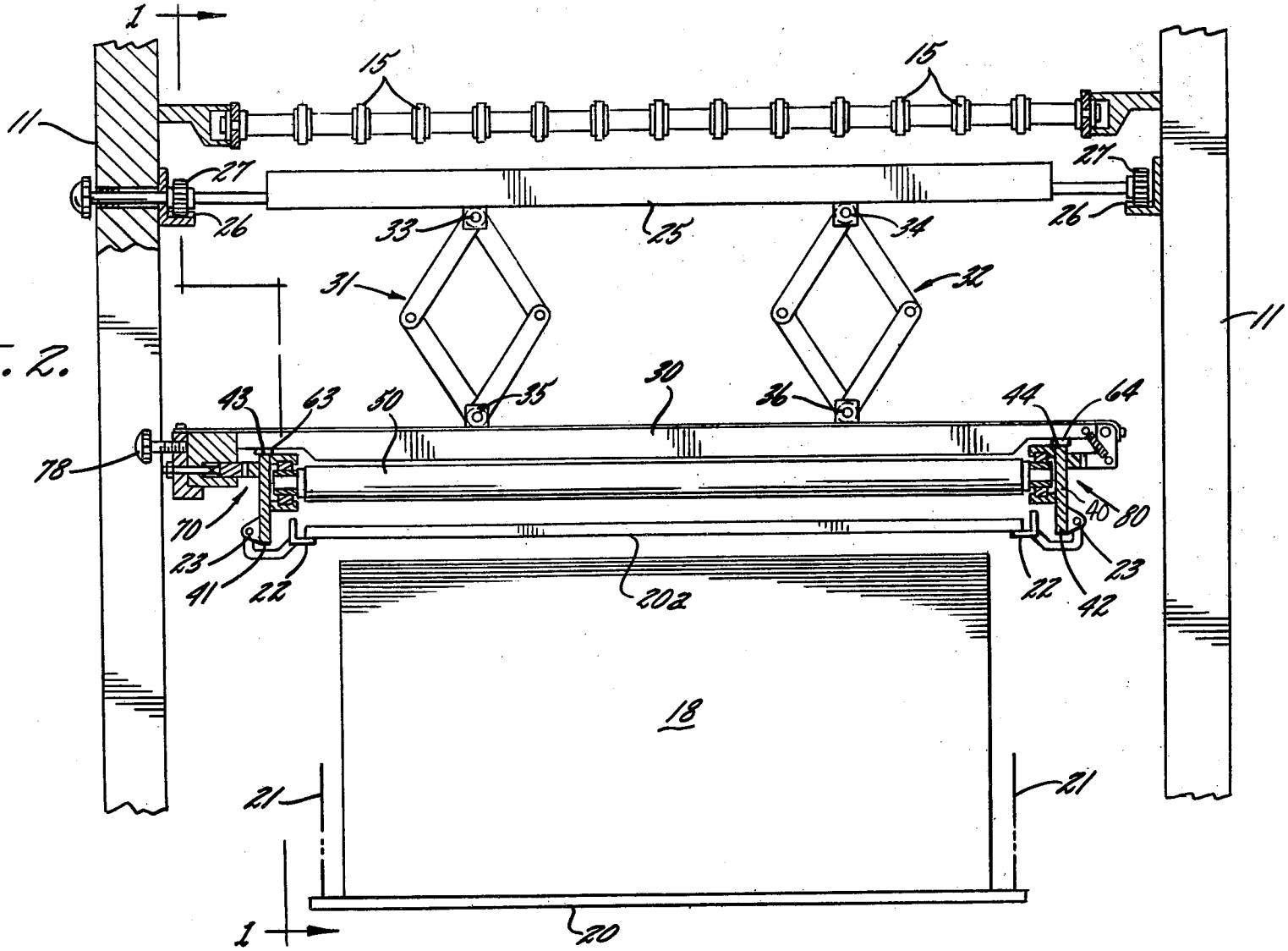
FIG. 2 is a diagrammatic front elevation in the form of a vertical section as viewed along line 2—2 in FIG. 1.

Referring now to FIGS. 1 and 2, a delivery mechanism 10 has a main frame 11 providing a delivery station 12. Extending into the frame is a chain type conveyor 13 trained about a drum 14 and which has grippers 15 spaced therealong each engaging the leading edge of a sheet, a typical sheet being indicated at 16. An automatically operated release mechanism 17 opens the grippers at the delivery station permitting the released sheet to settle downwardly first to form a pile 18 and then to form a pile 18*a*. The pile 18 is supported upon a pile board 20 having the usual supports 21 which can be progressively lowered as the pile builds up. For supporting a new pile board, indicated at 20*a*, at the upper limit of its range of movement and prior to progressive lowering, rails 22 are provided which are mounted upon hinges 23 to permit swinging them downwardly out of the way as the supports 21 take over the lowering movement.

At the delivery station a braking assembly 25 is provided. Such assembly, per se well known to those skilled in the art, includes a friction surface (not shown) against which the tail of each passing sheet is drawn by vacuum to decelerate the sheet. The braking assembly 25 is horizontally adjustable along a pair of toothed rails, or racks, 26, with the assembly being located in position on each rack by means of an adjustable pinion 27. Forward movement of the sheet is limited by a front stop 28.

In accordance with the present invention a rear edge guide is provided in the form of a traverse member for positioning the rear edges of the downwardly settling sheets. Further, an intermediate stacking mechanism is provided having a horizontal frame which is vertically adjustable with respect to the main frame and having an intermediate pile receiver. The intermediate pile receiver is movable horizontally on the frame between an out-of-the-way position and an interposed receiving position in the path of downward settling movement of the sheets for receiving the sheets during the time that a filled pile board is removed and replaced by an empty one. The traverse member has a suspension linkage, preferably in the form of a pantograph, for vertically suspending the same from the brake assembly for horizontal adjusting movement in unison therewith, the suspension linkage being vertically extensible so that the traverse member may follow the vertical movement of the frame of the intermediate stacking mechanism.

Thus, referring to FIG. 2 of the drawings a traverse member 30 is provided positioned horizontally to define the rear edge of the receiving station. The traverse member is supported upon pantograph linkages 31, 32 having upper points of pivoting 33, 34 and lower points of pivoting 35, 36 respectively.

Mounted in the receiving space is an intermediate stacking mechanism 40 having a frame including a pair of parallel side members 41, 42 with upper edges in the form of way surfaces 43, 44. Extending between the side members 41, 42 of the frame is an intermediate pile receiver in the form of a series of rollers 50 arranged side-by-side parallel to one another and interconnected by links 51. The rollers have individual bearings 52 which are supported upon a track 53. For the details of such a receiver cross reference is made to British Patent No. 1,196,687 and German laid open publication No. 1,116,239.

For the purpose of supporting the weight of the traverse member 30 on the frame members 41, 42 while permitting free movement of the traverse member therealong when the brake assembly is moved backwardly or forwardly, the traverse member is fitted with captive rollers 63, 64 riding on the respective way surfaces 43, 44.

In accordance with one of the aspects of the present invention means are provided for locking the ends of the traverse member to the side frame members of the intermediate stacking mechanism. This is accomplished, at the left-hand side (see FIGS. 3 and 5), by a detent assembly 70 consisting of a fixed rack 71 on the frame member 41 and a movable detent 72. The detent is mounted upon a plunger 73 slidably mounted in a body 74 secured to the left-hand end of the traverse member 30. The plunger 73 extends through a jack member 75 being retained against relative movement by a retaining nut 76. Threaded into the jack member 75 is a jack screw 77 having a knob 78. The plunger 73, and the jack member 75 which it engages, are biased to the right by a coil spring 79 which surrounds the plunger.

At the other, or right-hand, end of the traverse member is a second detent assembly 80 including a rack 81 which is fixed to the frame member 42 and a movable detent 82 which has a pivot connection 83 with the right-hand end of the traverse member. A coil spring 85 urges the detent 82 into the clockwise, or engaging, direction.

For the purpose of connecting the two detent assemblies 70, 80 together for actuation at the same time by the knob 78, a metal actuator strip 86 is provided which extends over the top of the traverse member and which is connected at its near end 87 to the jack member 75 and at its far end 88 to the detent 82. Accordingly, when the jack screw 77 is unscrewed by the knob 78 the two biasing springs 79 and 85 cause the detents to be engaged at each end of the traverse member to lock the same in place, as in FIG. 3. However, when it is desired to reposition the traverse member with the brake to which it is secured, the knob 78 is turned placing the jack screw 77 and jack member 75 in the condition shown in FIG. 5, causing disengagement of the detent 72. Simultaneously, the actuator strip 86 is drawn to the left causing the detent 82 at the other end of the traverse member to rotate counterclockwise against the force of spring 85 resulting in disengagement at that end, also. This releases the traverse member for braodwise movement, backwardly or forwardly with the brake assembly, into a new condition of adjustment, whereupon the knob 78 is unscrewed to restore the mechanism to the locked condition illustrated in FIG. 3.

In accordance with one of the features of the present invention the horizontal frame of the intermediate stacking mechanism, including the side members 41, 42 thereof, is movable vertically with respect to the associated main frame members, and the supporting linkage, indicated at 31, 32 is vertically extensible to accommodate such vertical adjustment. Thus, adjusting elements 91, 92, diagrammatically shown in FIG. 3, are interposed between the main frame 11 and the frame member 41, 42, respectively, while the linkages 31, 32 are in the form of a collapsible pantograph as shown in FIG. 2. Use of the pantograph geometry is desirable since it provides a wide range of vertical accommodation in a linkage which is both simple and economical. The pantograph thus serves a dual function: In the first place it provides a permanent connection between the traverse member and the brake assembly so that when the brake assembly is horizontally adjusted, either backwardly or forwardly in the direction of sheet movement (the locking detents being disengaged as in FIG. 5), the traverse member is automatically moved into a position of horizontal adjustment. The second function performed is that when the ends of the traverse member are locked in place on the frame of the intermediate stacking mechanism (FIGS. 2 and 3), such stacking mechanism may be moved up or down as desired, utilizing the adjustments 91, 92, with assurance that accommodating movement will take place in the pantograph thus causing the traverse member to move up and down with the intermediate stacking mechanism.

The features and advantages of the above construction may be more clearly understood upon considering a typical adjusting and pile change sequence as set forth in the stop motion views FIGS. 6–11 inclusive.

Figure 6:
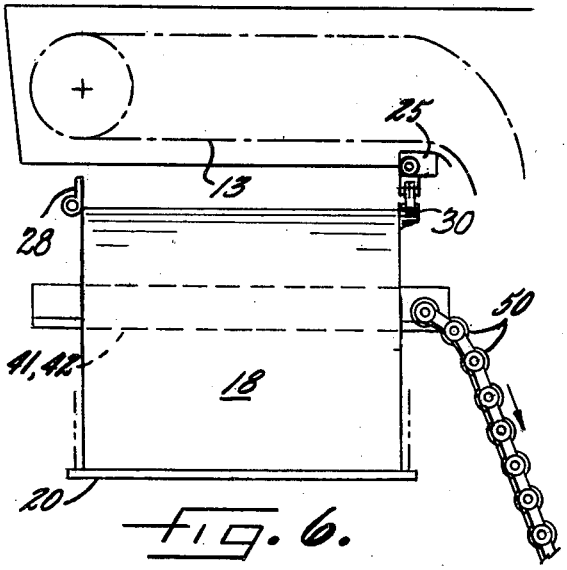

In FIG. 6 the pile 18 is shown in its final stages, accepting sheets from the conveyor 13 which are positioned by the traverse member 30, with the rollers 50, which form the intermediate pile receiver, occupying an out-of-the-way position.

Figure 7:
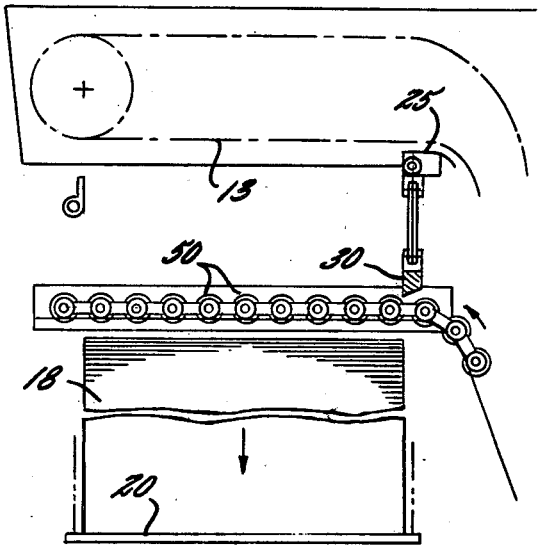

When a pile change is initiated the pile 18 is lowered as shown in FIG. 7 and the rollers 50 are interposed to catch the settling sheets.

Figure 8:
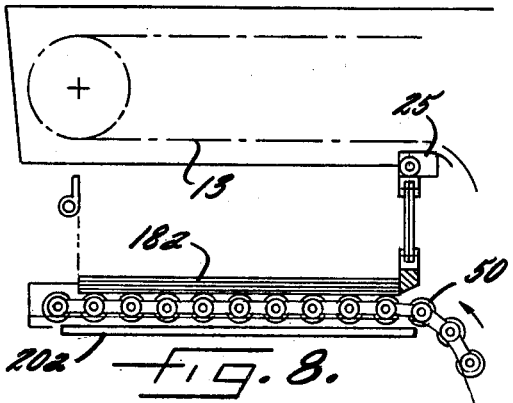

With the rollers 50 in place, as in FIG. 8, the stack 18 on pile board 20 is removed and the new pile board **20*a* is slid into place on rails 22 (see also FIG. 3). The sheets which are collected to form the intermediate pile 18*a* are all registered, along the rear edge, by the traverse member 30**.

Figure 9:
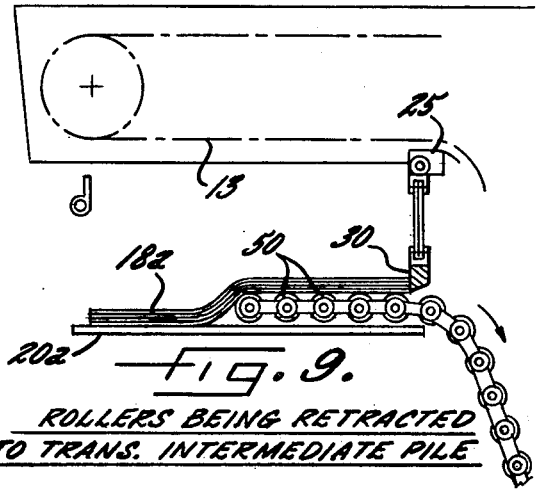
Figure 10:
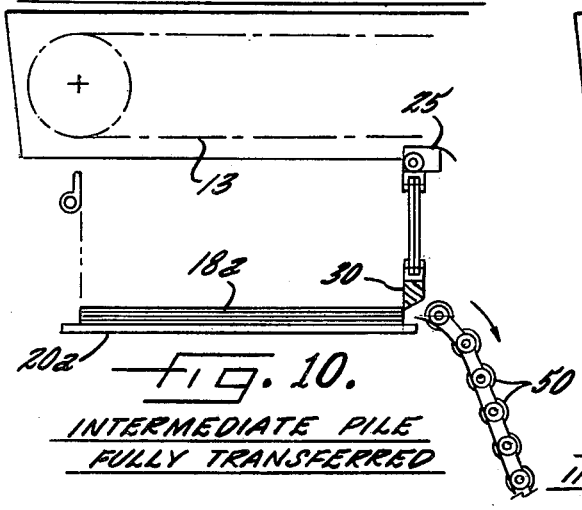

When the intermediate pile **18*a* is at a desired height the rollers 50 may be retracted to their out-of-the-way position as illustrated in FIG. 9, whereupon the pile is transferred to the new pile board 20*a*. Retraction of the rollers 50 continues until the pile 18*a* has been fully transferred as shown in FIG. 10**.

Figure 11:
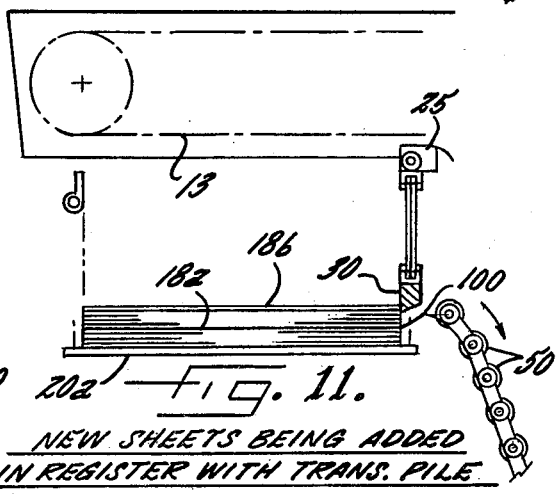

With the rollers 50 occupying the out-of-the-way position additional sheets are dropped on top of the pile **18*a* by the conveyor 13, the additional sheets being indicated at 18*b* in FIG. 11. It will be noted that the portions 18*a*, 18*b* of the pile are in perfect register along their rear edge, at 100, since both have been registered by the traverse member 30 which is locked in adjusted, registering position. Because of the length of the traverse member the illustrated condition of register is constant along the length of the entire rear edge of the pile, free of any relative skew. Additional sheets descend from the conveyor and are collected on the pile until the pile again builds up to the height illustrated in FIG. 6**, whereupon the changing sequence is repeated.

When it is desired to change to a different sheet format, for example, to a sheet of different length, the detent mechanisms 70, 80 are first released as illustrated in FIG. 5 whereupon the brake assembly 25 may be moved to a new position along its supporting rails, or racks, 26. Because of the fact that the traverse member is connected to the brake assembly by the pantograph linkage 31, 32, the traverse member moves in unison to its new position, freely supported upon the rollers 63, 64 (FIG. 3) which ride along the upper edges of the frame members 41, 42. The knob 78 is then turned to restore the detent mechanisms 70, 80 to their locked condition as illustrated in FIG. 3. With the traverse 30 in a new and appropriate position the pile change sequence is the same as already discussed in connection with FIGS. 6–11.

It will be apparent to one skilled in the art that the sheet registering and pile change mechanism described overcomes the drawbacks of the mechanisms which have been employed in the past and amply meets the objects set forth above.

We claim:

1. In a delivery mechanism for a sheet fed printing press the combination comprising a main frame, a delivery station within said frame, a chain type conveyor having grippers for engaging the leading edges of successive sheets for transporting the sheets into the delivery station, means at the delivery station for releasing the sheets so that they settle downwardly one by one, a main pile board for normally receiving the sheets, means for supporting the main pile board in an upraised position and for progressively lowering the board as the sheets accumulate thereon, a rear edge guide in the form of a traverse member for positioning the rear edges of the downwardly settling sheets, a brake assembly at the delivery station for engaging the trailing edges of the sheets for decelerating the sheets, the brake assembly being horizontally adjustable to accommodate sheets of different length, an intermediate stacking mechanism having a horizontal frame and having an intermediate pile receiver, the intermediate pile receiver being movable horizontally on the frame between an out-of-the-way position and an interposed receiving position in the path of downward settling movement of the sheets for receiving the sheets during the time that a filled pile board is removed and replaced by an empty one, the traverse member having a suspension linkage for vertically suspending the same from the brake assembly for horizontal adjusting movement in unison therewith, means for locking the ends of the traverse member to the frame of the intermediate stacking mechanism for positively holding the traverse member in its horizontally adjusted position, the frame of the intermediate stacking mechanism being vertically adjustable with respect to the main frame, the suspension linkage being vertically extensible so that the traverse member may follow the vertical movement of the frame of the intermediate stacking mechanism enabling the traverse member to serve as a positively positioned rear edge guide for both (a) the sheets which are deposited to form an intermediate pile and (b) the sheets which are subsequently deposited thereon to form a main pile with the result that all of the sheets in the main pile are in precise register.

2. The combination as claimed in claim 1 in which the intermediate pile receiver presents to the sheets deposited thereon an anti-friction surface so that when the intermediate pile receiver is moved from its receiving position to its out-of-the-way position the deposited sheets are held stationary in registered position by the traverse member.

3. The combination as claimed in claim 2 in which the intermediate pile receiver is made up of a series of anti-friction rollers arranged side by side.

4. The combination as claimed in claim 1 in which the suspension linkage is in the form of a pantograph.

5. The combination as claimed in claim 1 in which the frame of the intermediate stacking mechanism has horizontal way surfaces and in which the traverse member has anti-friction means for riding on such way surfaces.

6. The combination as claimed in claim 5 in which the anti-friction means is in the form of rollers which are captive with the traverse member and which roll upon the way surfaces.

7. The combination as claimed in claim 1 in which the means for locking the ends of the traverse member to the frame of the intermediate stacking mechanism is in the form of toothed multiposition detent assemblies at the respective ends of the traverse member.

8. The combination as claimed in claim 7 in which each detent assembly consists of a rack-like fixed part and a detent movable with respect thereto between free and clutched positions, the movable parts being operatively coupled and having a single manual operator for moving them simultaneously into corresponding positions.

* * * * *